United States Patent [19]

Gundlach

[11] Patent Number: 5,023,665

[45] Date of Patent: Jun. 11, 1991

[54] EXCESS LIQUID CARRIER REMOVAL APPARATUS

[75] Inventor: Robert W. Gundlach, Victor, N.Y.

[73] Assignee: Xerox Corporation, Stamford, Conn.

[21] Appl. No.: 544,565

[22] Filed: Jun. 27, 1990

[51] Int. Cl.[5] ..... G03G 15/10

[52] U.S. Cl. ..... 355/256; 118/652; 355/296

[58] Field of Search ..... 355/256, 296; 118/661, 118/652; 34/15, 16, 92

[56] References Cited

U.S. PATENT DOCUMENTS

| | | | |
|---|---|---|---|
| 3,722,994 | 3/1973 | Tanaka et al. . | |
| 3,741,643 | 6/1973 | Smith et al. . | |
| 4,161,361 | 7/1979 | Soma et al. . | |
| 4,181,094 | 1/1980 | Gardiner | 118/652 |
| 4,259,006 | 3/1981 | Phillips | 118/662 X |
| 4,286,039 | 8/1981 | Landa et al. | 118/661 X |
| 4,353,639 | 10/1982 | Moraw et al. | 118/661 X |
| 4,420,244 | 12/1983 | Landa . | |
| 4,733,273 | 3/1988 | Lloyd | 355/10 |
| 4,870,462 | 9/1989 | Day | 355/256 |
| 4,878,090 | 10/1989 | Lunde | 355/256 |

FOREIGN PATENT DOCUMENTS

| | | | |
|---|---|---|---|
| 53-10442 | 1/1978 | Japan . | |
| 58-49970 | 3/1983 | Japan | 355/256 |

*Primary Examiner*—R. L. Moses

*Attorney, Agent, or Firm*—H. Fleischer; J. E. Beck; R. Zibelli

[57] ABSTRACT

An electrophotographic printing machine in which an electrostatic latent image recorded on a moving photoconductive member is developed with a liquid developer material having a liquid carrier and toner particles to form a toner particle image. The toner particle image is and liquid carrier are transferred from the photoconductive member to a sheet of support material. An electrically biased electrode having a slit therein coupled to a vacuum pump removes, through the slit, liquid carrier from the gap between the electrode and photoconductive member. The electrical bias on the electrode generates an electrical field sufficient to maintain the toner particle image substantially undisturbed as air and liquid carrier are withdrawn from the gap.

15 Claims, 2 Drawing Sheets

EXCESS LIQUID CARRIER REMOVAL APPARATUS

Figure 1:
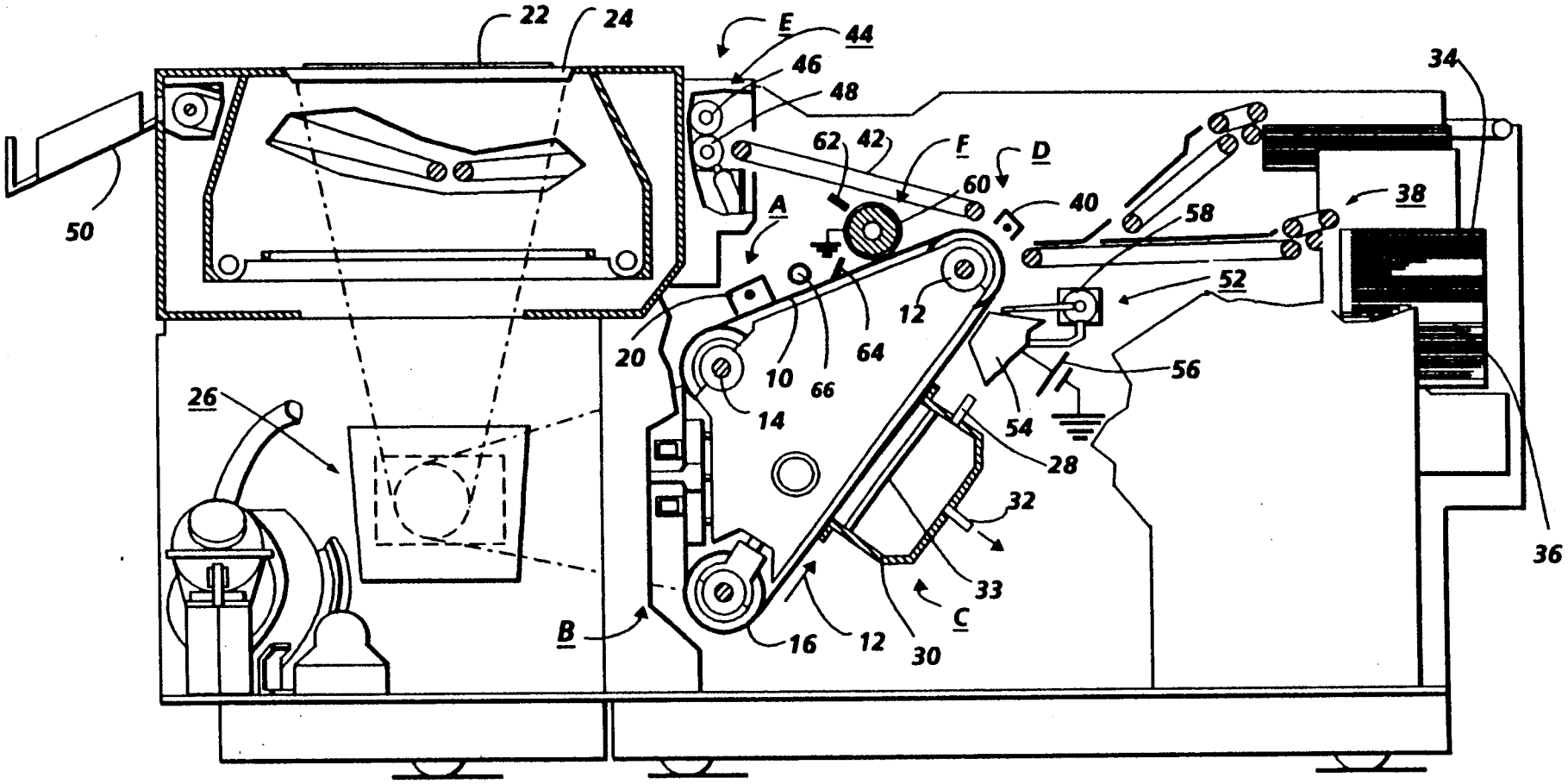

This invention relates generally to an electrophotographic reproducing machine, and more particularly concerns an electrically biased electrode having a slit therein for withdrawing air and excess liquid carrier from the photoconductive member without disturbing the developed image.

A typical electrophotographic printing machine employs a photoconductive member that is charged to a substantially uniform potential so as to sensitize the surface thereof. The charged portion of the photoconductive member is exposed to a light image of an original document being reproduced. Exposure of the charged photoconductive member selectively dissipates the charge thereon, in the irradiated areas, to record an electrostatic latent image on the photoconductive member corresponding to the informational areas contained within the original document. After the electrostatic latent image is recorded on the photoconductive member, the latent image is developed by bringing a developer material into contact therewith. Two types of developer materials are typically employed in electrophotographic reproducing machines. One type of developer material is known as a dry developer material and comprises carrier granules having toner particles adhering triboelectrically thereto. Alternatively, the developer material may be a liquid material comprising a liquid carrier having pigmented particles dispersed therein. In either case, the image recorded on the photoconductive member is developed and transferred to a sheet of support material. Thereafter, the developed image on the sheet of support material is heated to permanently fuse it thereto.

When using a liquid developer material, excess liquid carrier frequently adheres to the photoconductive member and is transferred to the copy sheet. The liquid carrier transferred to the copy sheet is absorbed by the paper and later evaporates into the room. Usually, about ½ gram of liquid carrier is absorbed by the copy paper and carried out in each copy. Reverse roll doctoring and corona doctoring reduce the amount of liquid carried out by the copy sheet from about ½ gram to about 120 milligrams per copy. Reverse roll doctoring provides superior background clean up by having sufficient shear force to remove all the liquid carrier except the liquid carrier electrostatically bonded to the pigmented particles. However, very close spacing is required to do an effective job. It is particularly difficult to maintain these close spacings over large dimensions in applications such as color proofing masters, and other graphic arts. An air knife could also remove excess liquid carrier. However, the pigmented particles adhering to the latent image may also be removed, thereby disturbing the image. Various techniques have been devised for removing excess liquid carrier from a photoconductive member. The following disclosures appear to be relevant:

JPPN No. 53-10442 Applicant: Katayama Published: Jan. 30, 1978

U.S. Pat. No. 4,733,273 Patentee: Lloyd Issued: Mar. 22, 1988

U.S. Pat. No. 4,878,090 Patentee: Lunde Issued: Oct. 31, 1989

The relevant portions of the foregoing disclosures may be briefly summarized as follows:

JPPN No. 53-10442 discloses a method of removing excess developing liquid by the co-action of an air knife and corona discharge. A corona discharge line is arranged in a nozzle from which compressed air flows.

U.S. Pat. No. 4,733,273 describes a roller that develops a latent image with liquid developer material during one portion of its rotation and wipes the developed image to remove excess liquid developer material during another portion of its rotation.

U.S. Pat. No. 4,878,090 discloses a development electrode surrounded by a shroud. A continuous supply of liquid toner is supplied to the space between the electrode and a record member. A vacuum draws air around the shroud to strike the record member and remove excess toner.

In accordance with one aspect of the features of the present invention, there is provided a printing machine of the type in which a toner particle image and liquid carrier are transferred from a moving member to a sheet of support material. The improvement includes vacuum means, positioned closely adjacent the moving member to define a gap therebetween, for withdrawing air and liquid carrier from the gap before transfer of the toner particle image to the sheet of support material. Means electrically bias the vacuum means to generate an electrical field sufficient to maintain the toner particle image substantially undisturbed as the vacuum means withdraws air and liquid carrier from the gap.

Pursuant to another aspect of the present invention, there is provided an electrophotographic printing machine, including a moving photoconductive member. Means record an electrostatic latent image on the photoconductive member. Means develop the electrostatic latent image recorded on the photoconductive member with a liquid developer material comprising at least a liquid carrier and toner particles to form a toner particle image on the photoconductive member. Means transfer the toner particle image and liquid carrier from the photoconductive member to a sheet of support material. Vacuum means, interposed between the transferring means and the developing means and positioned closely adjacent the moving photoconductive member to define a gap therebetween, withdraws air and liquid carrier from the gap. Means are provided for electrically biasing the vacuum means to generate an electrical field sufficient to maintain the toner particle image substantially undisturbed as the vacuum means withdraws air and liquid carrier from the gap.

Figure 2:
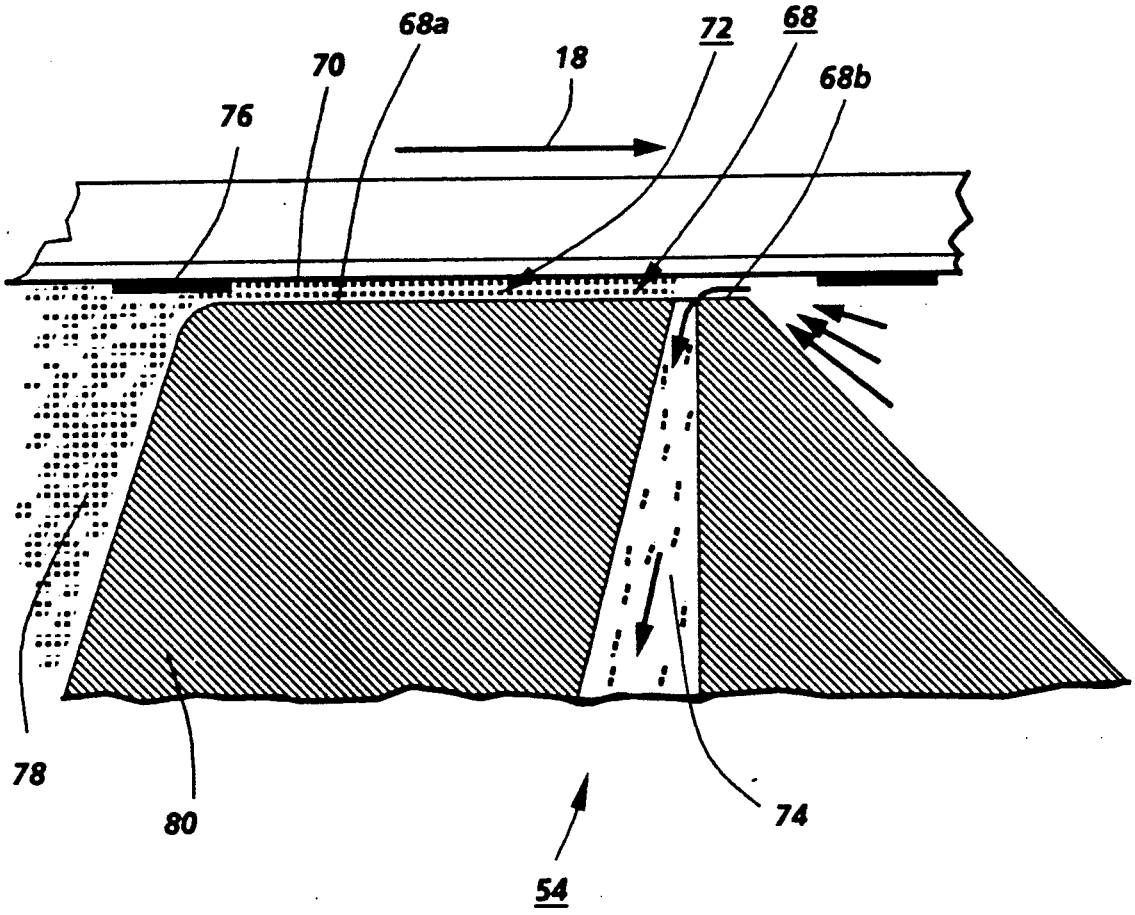

Other aspects of the present invention will become apparent as the following description proceeds and upon reference to the drawings, in which:

FIG. 1 is a schematic elevational view depicting an electrophotographic printing machine incorporating the features of the present invention therein; and FIG. 2 is an elevational view, partially in section, showing an electrode used in the FIG. 1 printing machine for removing liquid carrier.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to designate identical elements. FIG. 1 is a schematic elevational view illustrating an electrophotographic printing machine incorporating the features of the present invention therein. It will become apparent from the following discussion, that the apparatus of the present invention is equally well suited for use in a wide variety of printing machines and is not necessarily limited in this application to the particular embodiment shown herein.

Turning now to FIG. 1, the printing machine employs a belt 10 having a photoconductive surface deposited on a conductive substrate. Preferably, the photoconductive surface is made from a selenium alloy with the conductive substrate being preferably made from an aluminum alloy which is electrically grounded. Belt 10 advances successive portions of the photoconductive surface sequentially through the various processing stations disposed about the path of movement thereof. The support assembly for belt 10 includes three rollers 12, 14, and 16 located with parallel axes at approximately the apexes of a triangle. Roller 12 is rotatably driven by a suitable motor and drive (not shown) so as to rotate and advance belt 10 in the direction of arrow 18.

Initially, belt 10 passes through charging station A. At charging station A, a corona generating device 20 charges the photoconductive surface of belt 10 to a relatively high, substantially uniform potential.

After the photoconductive surface of belt 10 is charged, the charged portion thereof is advanced to exposure station B. At exposure station B, an original document 22 is placed on a transparent support platen 24. An illumination assembly, indicated generally by the reference numeral 26, illuminates the original document 22 on platen 24 to produce image rays corresponding to the informational areas of the original document. The image rays are projected by means of an optical system onto the charged portion of the photoconductive surface. The light image dissipates the charge in selected areas to record an electrostatic latent image on the photoconductive surface which corresponds to the informational areas contained within original document 22. One skilled in the art will appreciate that in lieu of a light lens optical system, a raster output scanner using a modulated laser beam may be used.

After the electrostatic latent image has been recorded on the photoconductive surface of belt 10, belt 10 advances the electrostatic latent image to development station C. At development station C, a developing liquid, comprising at least an insulating carrier liquid and toner particles, i.e. pigmented marking particles, is circulated from any suitable source (not shown) through pipe 28 into a development tray 30 from which it is drawn through pipe 32 for recirculation. Development electrode 33, which may be appropriately electrically biased, assist in depositing toner particles on the electrostatic latent image as it passes in contact with the developing liquid. The charged toner particles, disseminated through the carrier liquid, pass by electrophoresis to the electrostatic latent image. The charge of the toner particles is opposite in polarity to the charge on the photoconductive surface. For example, if the photoconductive surface is made from a selenium alloy, the corona charge will be positive and the toner particles will be negatively charged. Alternatively, if the photoconductive surface is made from a cadmium sulfide material, the charge will be negative and the toner particles will have a positive charge. Normally, the amount of liquid on the photoconductive surface is excessive. A suitable liquid developer material is described in U.S. Pat. No. 4,582,774, issued to Landa in 1986, the relevant portions thereof being hereby incorporated into the present application. A suitable insulating carrier liquid may be made from an aliphatic hydrocarbon, such as an Isopar, which is a trademark of the Exxon Corporation, having a low boiling point. These are branched chained paraffinic hydrocarbon liquid (largely decane). The toner particles comprise at least a binder and pigment. The pigment may be carbon black. However, one skilled in the art will appreciate that any suitable liquid developer material may be employed.

Next, the developed image advances to the apparatus for removing liquid carrier therefrom, indicated generally by the reference numeral 52. Liquid carrier removal apparatus 52 has an electrode, indicated generally by the reference numeral 54, positioned closely adjacent to photoconductive belt 10. Voltage source 56 electrically biases electrode 54 to substantially the same magnitude and polarity as the electrical bias applied to development electrode 33. A vacuum pump 58 is connected to electrode 54. The vacuum pump withdraws liquid carrier and air from the gap between electrode 54 and photoconductive belt 10. The electrical bias applied by voltage source 56 on electrode 54 insures that the toner particle image developed on photoconductive belt 10 remains substantially undisturbed under the flow of air and liquid carrier. Electrode 54 will be discussed hereinafter in further detail with reference to FIG. 2.

After the excessive liquid carrier is removed from belt 10, belt 10 advances the developed image to transfer station D. At transfer station D, a sheet of support material 34 is advanced from stack 36, by a sheet transport mechanism, indicated generally by the reference numeral 38. Transfer station D includes a corona generating device 40 which sprays ions onto the backside of the sheet of support material 34. This attracts the developed image from the photoconductive surface of belt 10 to copy sheet 34. Ideally, only the pigmented or toner particles will be transferred to the copy sheet. However, not all of the liquid carrier is removed from the photoconductive belt 10. This results in some residual liquid carrier interstitially held in the toner particle image permitting the toner particle image to be electrophoretically transferred to the copy sheet. Thus, the copy sheet contains a minimal amount of liquid carrier as it advances from transfer station D to fusing station E. Conveyor belt 42 is adapted to move the sheet of support material, i.e. the copy sheet, to fusing station E.

Fusing station E includes a fuser assembly, indicated generally by the reference numeral 44, which permanently fuses the developed image to the copy sheet. Fuser assembly 44 includes a heated fuser roll 46 and a back-up or pressure roll 48 resiliently urged into engagement therewith to form a nip through which the copy sheet passes. After fusing, the finished copy is discharged to output tray 50 for removal therefrom by the machine operator.

With continued reference to FIG. 1, after excess liquid carrier is removed and the developed image transferred to the copy sheet, residual liquid developer material remains adhering to the photoconductive surface of belt 10. A cleaning roller 60, formed of any appropriate synthetic resin, is driven in a direction opposite to the direction of movement of belt 10 to scrub the photoconductive surface clean. To assist in this cleaning action, developing liquid may be fed through pipe 62 to the surface of cleaning roller 60. A wiper blade 64 completes the cleaning of the photoconductive surface. Any residual charge left on the photoconductive surface is extinguished by flooding the photoconductive surface with light from lamps 66.

Referring now to FIG. 2, there is shown the detailed structure of electrode 54. As shown, electrode 54 has a generally planar surface indicated generally by the reference numeral 68. Planar surface 68 is positioned closely adjacent to exterior surface 70 of photoconductive belt 10 and defines a gap, indicated generally by the reference numeral 72, therebetween. Planar surface 68 of electrode 54 is substantially parallel to surface 70 of photoconductive belt 10. Electrode 74 has a slit 74 connected to vacuum pump 58. Toner particles 76 are shown adhering to surface 70 of photoconductive belt 10. Liquid carrier 78 also adheres to surface 70 of belt 10 and moves therewith in the direction of arrow 18. A portion of liquid carrier 78 is sheared from the developed image by lead edge 80 of electrode 54. However, additional liquid carrier 78 continues to move with the developed image into the gap 72. Liquid carrier 78 and air are sucked away from the toner image into slit 74 by the reduced air pressure formed therein by vacuum pump 58 (FIG. 1). The electrical bias applied on electrode 54 forms an electrical field which maintains the toner image undisturbed as the liquid carrier and air are withdrawn therefrom. Preferably, gap 72 ranges from about 50 micrometers to about 100 micrometers. The width of slit 74 is equal to or less than gap 72. This insures continual electrical fields between electrode 54 and the developed image surface 70. Portion **68*a* of planar surface 68 is located upstream of slit 74 in the direction of movement of photoconductive belt 10, as indicated by reference numeral 18. Portion 68*b* is located downstream of slit 74 in the direction of movement of photoconductive belt 10, as indicated by reference numeral 18. Portion 68*a* is at least ten times longer than portion 68*b* in the direction of movement of photoconductive belt 10 as indicated by reference numeral 18. By providing a relatively long gap filled with liquid carrier over portion 68*a* before the surface 70 having the image thereon reaches slit 74, air will be drawn through the gap only over portion 68*b***.

One skilled in the art will appreciate that while the liquid carrier removal apparatus of the present invention has been described in conjunction with a printing machine wherein the developed image is transferred directly from the photoconductive surface to the copy sheet, it may also be used in a printing machine wherein the developed image is transferred from the photoconductive surface to an intermediate member and, subsequently, from the intermediate member to the copy sheet. In a printing machine of the latter type, the liquid carrier removal apparatus is located adjacent the intermediate member before the station for transferring the developed image from the intermediate member to the copy sheet.

In recapitulation, the liquid carrier removal apparatus withdraws air and liquid carrier from the developed image through a slit in an electrode coupled to a vacuum pump. The electrode is electrically biased to maintain the toner particles of the developed image undisturbed as the liquid carrier and air are removed therefrom.

It is, therefore, apparent that there has been provided, in accordance with the present invention, an apparatus for removing liquid carrier that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and board scope of the appended claims.

I claim:

1. A printing machine of the type in which a toner particle image and liquid carrier are transferred from a moving member to a sheet of support material, wherein the improvement includes:

vacuum means, positioned closely adjacent the moving member to define a gap therebetween, for withdrawing air and liquid carrier from the gap before transfer of the toner particle image to the sheet of support material; and means for electrically biasing said vacuum means to generate an electrical field sufficient to maintain the toner particle image substantially undisturbed as said vacuum means withdraws air and liquid carrier from the gap.

2. A printing machine according to claim 1, wherein said vacuum means includes:

an electrode member having a surface opposed from a surface of the moving member to define a relatively long gap therebetween, said electrode member having an aperture therein extending across the moving member in a direction substantially perpendicular to the direction of movement of the moving member; and a vacuum pump connected to the aperture in said electrode member to withdraw air and liquid carrier from the gap.

3. A printing machine according to claim 2, wherein the portion of the surface of said electrode member upstream of the aperture is at least ten times the size of the portion of the surface downstream of the aperture.

4. A printing machine according to claim 3, wherein air is drawn into the aperture from the portion of the gap downstream of the aperture with liquid carrier being delivered into the aperture from the portion of the gap upstream of the aperture.

5. A printing machine according to claim 4, wherein the aperture in said electrode means is a slit extending across the moving member in a direction substantially perpendicular to the direction of movement of the moving member.

6. A printing machine according to claim 5, wherein the width of the slit, in a direction substantially parallel to the direction of movement of the moving member, is equal to or less than the gap.

7. A printing machine according to claim 6, wherein the gap ranges from about 50 micro meters to about 200 micro meters.

8. An electrophotographic printing machine, including:

a moving photoconductive member;

means for recording an electrostatic latent image on said photoconductive member;

means for developing the electrostatic latent image recorded on said photoconductive member with a liquid developer material comprising at least a liquid carrier and toner particles so as to form a toner particle image on said photoconductive member;

means for transferring the toner particle image and liquid carrier from said photoconductive member to a sheet of support material;

vacuum means, interposed between said transferring means and said developing means and positioned closely adjacent said moving photoconductive member to define a gap therebetween, for withdrawing air and liquid carrier from the gap; and means for electrically biasing said vacuum means to generate an electrical field sufficient to maintain the toner particle image substantially undisturbed as said vacuum means withdraws air and liquid carrier.

9. A printing machine according to claim 8, wherein said vacuum means includes:

an electrode member having a surface opposed from a surface of the moving member to define a relatively long gap therebetween, said electrode member having an aperture therein extending across the moving photoconductive member in a direction substantially perpendicular to the direction of movement of the moving photoconductive member; and a vacuum pump connected to the aperture in said electrode means to withdraw air and liquid carrier from the gap.

10. A printing machine according to claim 9, wherein the portion of the surface of said electrode member upstream of the aperture is at least ten times the size of the portion of the planar surface of said electrode member downstream of the aperture.

11. A printing machine according to claim 10, wherein air is drawn into the aperture from the portion of the gap downstream of the aperture with liquid carrier being delivered into the aperture from the portion of the gap upstream of the aperture.

12. A printing machine according to claim 11, wherein the aperture in said electrode means is a slit extending across the moving photoconductive member in a direction substantially perpendicular to the direction of movement of the moving photoconductive member.

13. A printing machine according to claim 12, wherein the width of the slit, in a direction substantially parallel to the direction of movement of the moving photoconductive member, is equal to or less than the gap.

14. A printing machine according to claim 13, wherein the gap ranges from about 50 micro meters to about 200 micro meters.

15. A printing machine according to claim 14, wherein said photoconductive member is a belt.

* * * * *